US008403438B2

(12) United States Patent
Park et al.

(10) Patent No.: US 8,403,438 B2
(45) Date of Patent: Mar. 26, 2013

(54) VARIABLE SHELF AND REFRIGERATOR HAVING THE SAME

(75) Inventors: Ho Sang Park, Gwangju-si (KR); Chang Yong Kim, Gwangju-si (KR); Sang Gyu Jung, Gwangju-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 0 days.

(21) Appl. No.: 12/801,103

(22) Filed: May 21, 2010

(65) Prior Publication Data

US 2011/0001415 A1 Jan. 6, 2011

(30) Foreign Application Priority Data

Jul. 2, 2009 (KR) ..... 10-2009-0060123

(51) Int. Cl.
*A47B 11/00* (2006.01)
*A47B 96/02* (2006.01)

(52) U.S. Cl. ..... 312/408; 108/143

(58) Field of Classification Search ..... 312/408, 312/410, 302, 306; 108/74–75, 86, 138, 108/106–108, 143
See application file for complete search history.

(56) References Cited

U.S. PATENT DOCUMENTS

| | | | | | |
|---|---|---|---|---|---|
| 1,576,034 | A | * | 3/1926 | Butt | 108/134 |
| 1,925,371 | A | * | 9/1933 | Charter | 211/153 |
| 2,057,429 | A | * | 10/1936 | Heim | 211/153 |
| 2,276,942 | A | * | 3/1942 | Dibble | 108/143 |
| 2,287,611 | A | * | 6/1942 | Harbison | 312/313 |
| 2,317,232 | A | * | 4/1943 | Swedman | 312/271 |
| 2,465,806 | A | * | 3/1949 | Jewell | 211/153 |
| 2,937,765 | A | * | 5/1960 | Shank | 108/143 |
| 3,311,072 | A | * | 3/1967 | Pattison | 108/143 |
| 3,368,784 | A | * | 2/1968 | Peterson | 248/245 |
| 3,859,932 | A | * | 1/1975 | Armstrong et al. | 108/75 |
| 4,437,572 | A | * | 3/1984 | Hoffman | 211/119.003 |
| 4,620,489 | A | * | 11/1986 | Albano | 108/105 |
| 5,484,196 | A | * | 1/1996 | Kim | 312/242 |
| 5,642,924 | A | * | 7/1997 | Wohlrab et al. | 312/408 |
| 5,645,182 | A | * | 7/1997 | Miller et al. | 211/134 |
| 5,813,741 | A | * | 9/1998 | Fish et al. | 312/408 |

(Continued)

FOREIGN PATENT DOCUMENTS

| | | | |
|---|---|---|---|
| JP | 01084085 A | * | 3/1989 |
| JP | 08-035765 | * | 2/1996 |

(Continued)

OTHER PUBLICATIONS

Machine Translation, Abstract of JP Publication No. 1084085.*

(Continued)

*Primary Examiner* — James O Hansen
*Assistant Examiner* — Kimberley S Wright
(74) *Attorney, Agent, or Firm* — Staas & Halsey LLP

(57) ABSTRACT

A refrigerator has a variable shelf which may include a first partition shelf mounted to be pivotable about a rear end thereof, and a second partition shelf mounted to move relative to the first partition shelf and therefore protrude to a front of the first partition shelf. When the first and second partition shelves are rotated about the rear end of the first partition shelf in a state where the second partition shelf is disposed at a lower part of the first partition shelf, it may be guaranteed a storage space even for item(s) higher than an interval between the shelves and wider than a front-to-rear width of the second partition shelf.

15 Claims, 10 Drawing Sheets

U.S. PATENT DOCUMENTS

| | | | | |
|---|---|---|---|---|
| 5,893,620 | A * | 4/1999 | Birgelis | 312/408 |
| 7,258,317 | B1 * | 8/2007 | Nagel | 248/244 |
| 7,731,316 | B2 * | 6/2010 | Wing | 312/408 |
| 2008/0030114 | A1 * | 2/2008 | Becke | 312/408 |
| 2009/0250420 | A1 * | 10/2009 | Martin et al. | 211/134 |
| 2010/0253197 | A1 * | 10/2010 | Jung | 312/408 |

FOREIGN PATENT DOCUMENTS

| | | | |
|---|---|---|---|
| KR | 10-0756887 | * | 9/2007 |
| WO | WO2006/122913 | * | 9/2006 |

OTHER PUBLICATIONS

Machine Translation JP, 08-035765, A (1996), "Loading Shelves for Electric Refrigerator".*

Machine Translation, KR, 10-0756887 ,"Foldable Shelf for Refrigerator".*

* cited by examiner

VARIABLE SHELF AND REFRIGERATOR HAVING THE SAME

CROSS-REFERENCE TO RELATED APPLICATIONS

This application claims the priority benefit of Korean Patent Application No. 2009-0060123, filed on Jul. 2, 2009 in the Korean Intellectual Property Office, the disclosure of which is incorporated herein by reference.

BACKGROUND

1. Field

Exemplary embodiments relate to a variable shelf partitioning an inner space of a storage chamber of a refrigerator into upper and lower spaces, and a refrigerator having the same.

2. Description of the Related Art

Generally, a refrigerator refers to an apparatus including component parts of a freezing cycle therein to generate a cold air and preserve items (articles) stored in the refrigerator in a refrigerating or freezing manner using the cold air.

Such a refrigerator includes a main body having a storage chamber to store groceries and a door to open and close the storage chamber. In addition, a plurality of shelves are arranged in the storage chamber to partition the inner space of the storage chamber into upper and lower spaces so that various items are efficiently stored.

Recently, a variable shelf is being applied to the refrigerator, which enables storage of one or more items relatively higher than an interval between the shelves (one or more items having a height greater than the distance between the shelves). The variable shelf may include a first partition shelf partitioning a rear space of the storage chamber upward and downward, and a second partition shelf movably mounted and overlapped with the first partition shelf.

Therefore, when an item relatively lower than an interval between the shelves is stored (an item having a height less than the distance between the shelves is stored), the second partition shelf may be disposed in front of the first partition shelf so that both rear and front spaces of the storage chamber are partitioned upward and downward by the first and second partition shelves. On the other hand, when a relatively high item is stored, the second partition shelf is moved toward the rear space to be overlapped with the first partition shelf such that only the rear space of the storage chamber is partitioned upward and downward. Accordingly, the high item may be stored in the front space of the storage chamber.

However, according to the above-structured conventional variable shelf, when it is required to store an item which is not only higher than the interval between the shelves but also wider than a front-to-rear width of the second partition shelf, the variable shelf needs to be totally removed from the storage chamber, which brings inconvenience to the user.

SUMMARY

An aspect of exemplary embodiments provide a variable shelf facilitating storage of one or more items which have relatively great height and front-to-rear width in a storage chamber of a refrigerator, and a refrigerator having the same.

In accordance with one aspect of exemplary embodiments, a variable shelf includes a first partition shelf mounted to be pivotable about a rear end thereof, and a second partition shelf mounted to move relative to the first partition shelf and therefore protrude to a front of the first partition shelf.

The variable shelf may further include a shelf frame having a pair of side frame parts supporting both sides of the first and second partition shelves.

The variable shelf may further include a first hinge part formed as a recess and disposed at any one of the rear end of the first partition shelf and the shelf frame, and a second hinge part formed as a projection and disposed at the other one to be rotatably connected with the first hinge part.

The variable shelf may further include first rails each formed on both sides of the first partition shelf, being extended in the forward and the backward direction, and second rails each formed on both sides of the partition shelf and movably connected to the first rails.

The variable shelf may further include third rails each extended in the forward and the backward direction on insides of the pair of side frame parts so that the second rails are movably mounted to the third rails.

Each of the third rails may include an inclination part formed at a front end thereof and slantingly extended to an upper front part and a first locking part extended downward from the front end of the inclination part, and each of the second rails comprises a second locking part extended downward from the front end thereof and engaged with the first locking part.

The variable shelf may further include a pair of supporting ribs protruded from front inner sides of the pair of side frame parts to support both front ends of the first partition shelf.

The pair of supporting ribs may be slantingly extended toward a rear lower part.

Each of the side frame parts may include a first guide projection protruded inwardly from the side frame part to guide a rear end of the second partition shelf, and a second guide projection protruded downward from the second partition shelf to guide the rear end of the second partition shelf upward through interaction with the first guide projection.

In accordance with another aspect of exemplary embodiments, a refrigerator includes a first partition shelf mounted to be pivotable about a rear end thereof, a second partition shelf mounted to move relative to the first partition shelf and therefore protrude to a front of the first partition shelf, a shelf frame having a pair of side frame parts supporting both sides of the first and second partition shelves, a first hinge part formed as a recess and disposed at any one of the rear end of the first partition shelf and the shelf frame, and a second hinge part formed as a projection and disposed at the other one to be rotatably connected with the first hinge part.

According to another exemplary embodiment, a refrigerator includes a main body including a storage chamber, and a variable shelf partitioning an inner space of the storage chamber into upper and lower spaces, wherein the variable shelf comprises a first partition shelf mounted to be pivotable about a rear end thereof, and a second partition shelf mounted to move relative to the first partition shelf and therefore protrude to a front of the first partition shelf.

The refrigerator may further include a shelf frame having a pair of side frame parts mounted at both inner sidewalls of the storage chamber to support both sides of the first and second partition shelves.

The refrigerator may further include a first hinge part formed as a recess and disposed at any one of the rear end of the first partition shelf, and a second hinge part formed as a projection and disposed at the other one to be rotatably connected with the first hinge part.

The shelf frame may be removably mounted in the storage chamber.

The refrigerator may further include a pair of supporting parts formed at both sides in the storage chamber to put the side frame parts thereon, respectively.

A refrigerator according to another exemplary embodiment includes a main body including a storage chamber, a variable shelf partitioning an inner space of the storage chamber into upper and lower spaces, and comprising a first partition shelf mounted to be pivotable about a rear end thereof, and a second partition shelf mounted to move relative to the first partition shelf and therefore protrude to a front of the first partition shelf, and a shelf frame removably mounted in the storage chamber, having a pair of side frame parts mounted at both inner sidewalls of the storage chamber to support both sides of the first and second partition shelves.

BRIEF DESCRIPTION OF THE DRAWINGS

These and/or other aspects of exemplary embodiments will become apparent and more readily appreciated from the following description of exemplary embodiments, taken in conjunction with the accompanying drawings of which.

DETAILED DESCRIPTION

Figure 1:
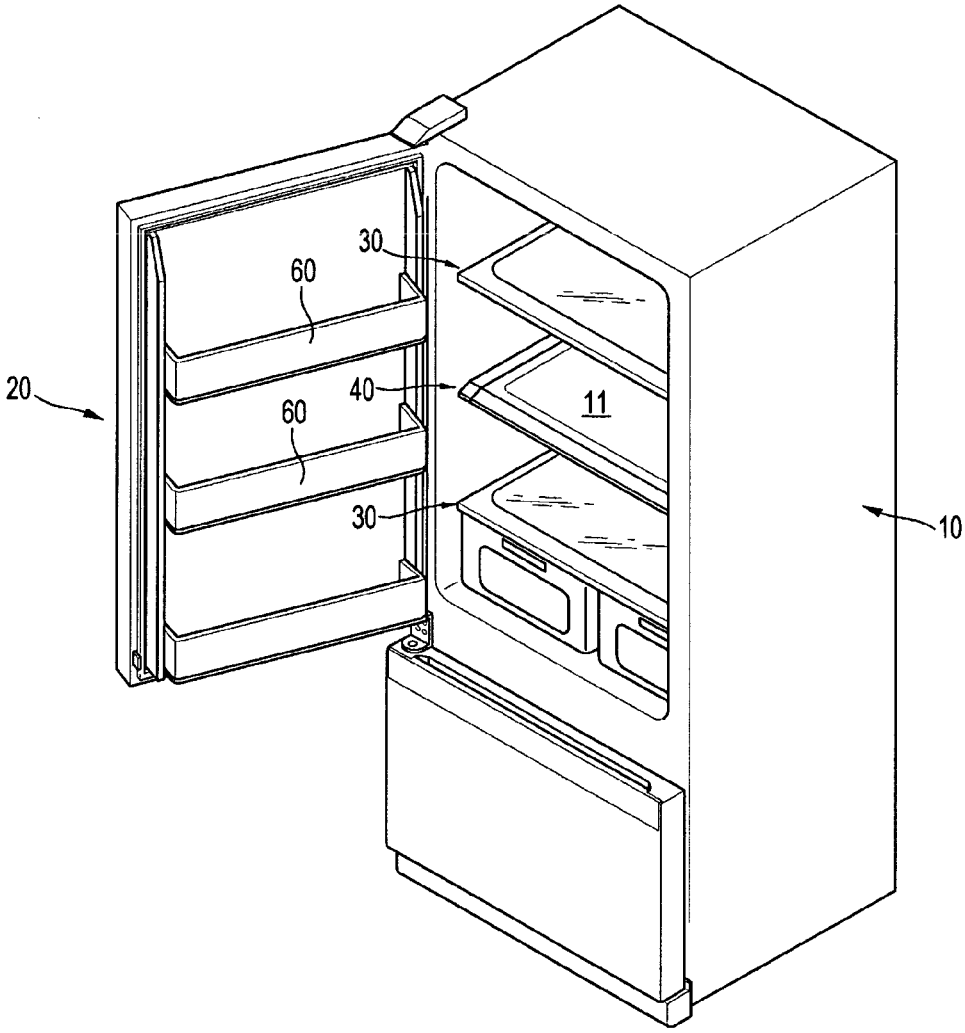
FIG. 1 is a perspective view of a refrigerator according to an exemplary embodiment.

Reference will now be made in detail to exemplary embodiments, examples of which are illustrated in the accompanying drawings, wherein like reference numerals refer to like elements throughout.

As shown in FIG. 1, a refrigerator according to an exemplary embodiment includes a main body 10 constituting the exterior look of the refrigerator and including a storage chamber 11 with its opened front side to store items (articles), and a door 20 pivotably mounted to one side of the main body 10 to open and close the storage chamber 11.

A plurality of shelves 30 and 40 are disposed in the storage chamber 11 so as to separately store lots of items (articles) in an efficient manner. Also, a plurality of door shelves 60 are mounted to an inner side of the door 20 to store beverage cans and bottles.

Figure 2:
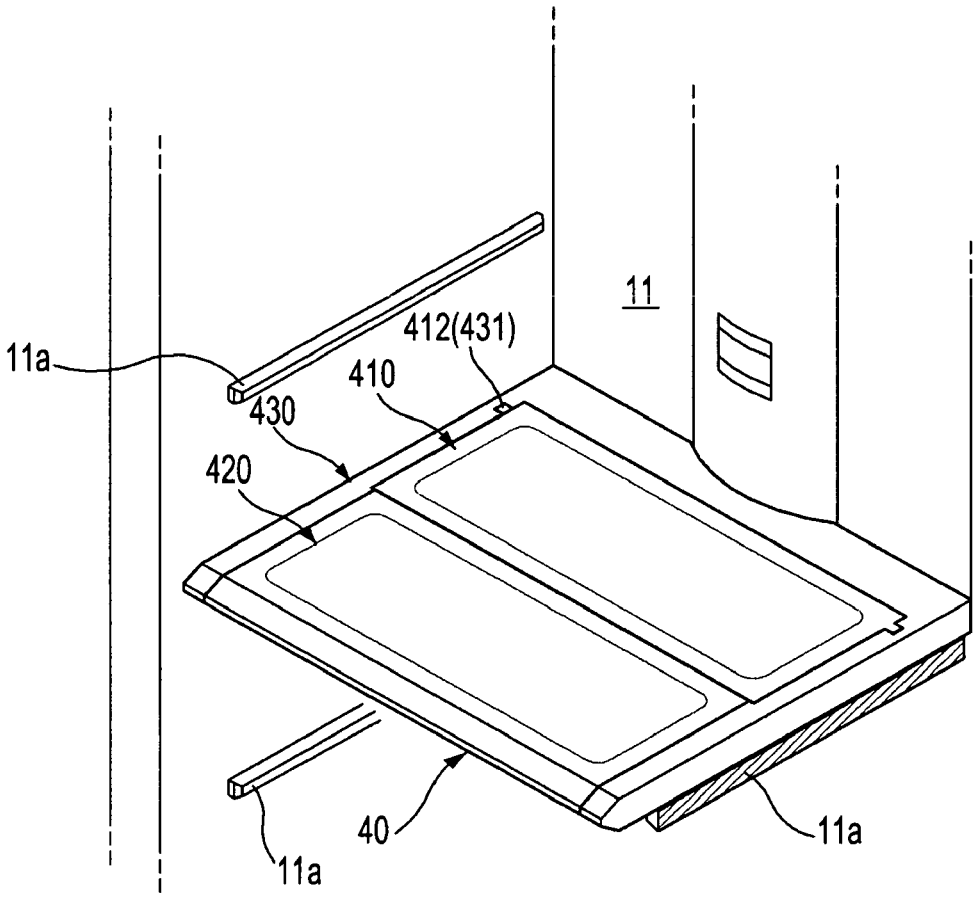
FIG. 2 is a perspective view of a variable shelf according to an exemplary embodiment.
Figure 3:
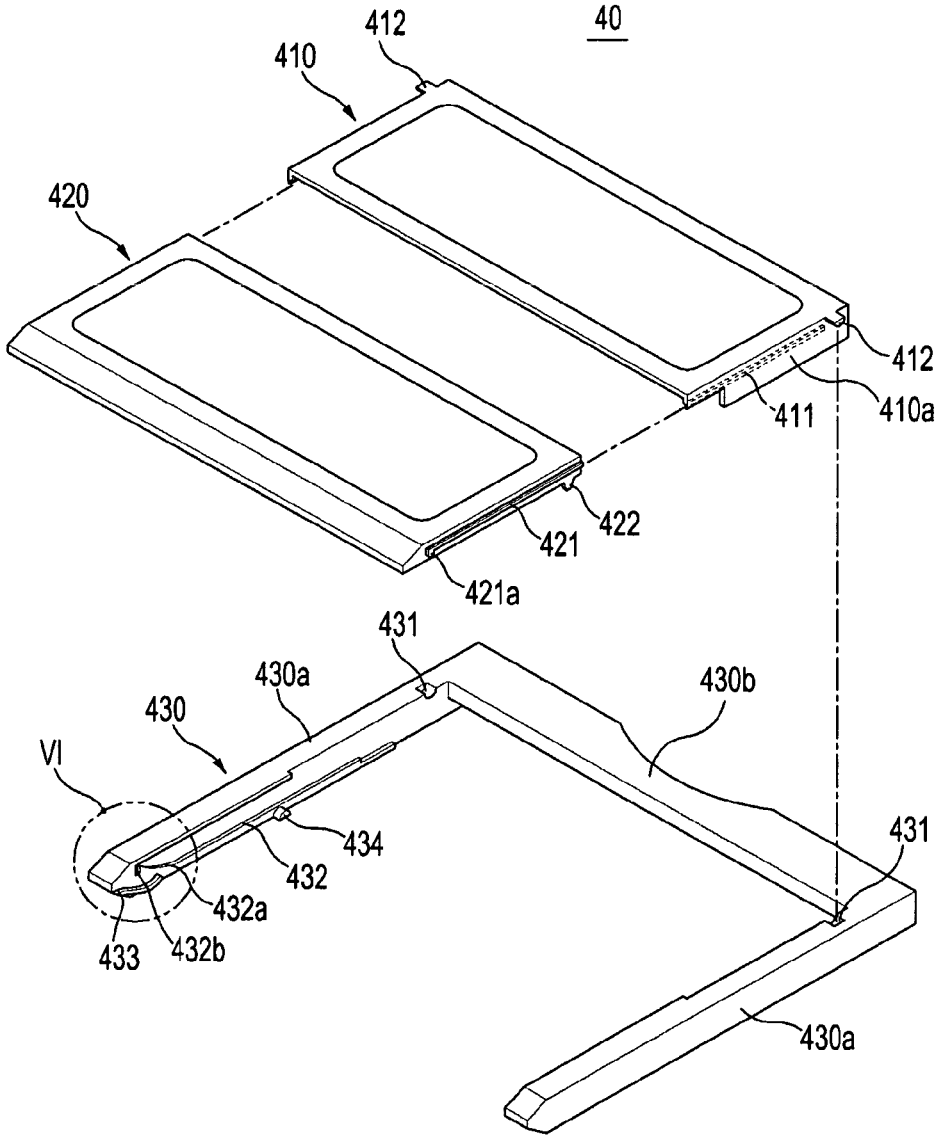
FIG. 3 is an exploded perspective view of the variable shelf according to an exemplary embodiment.

The shelves 30 and 40 mounted in the storage chamber 11 may be divided into a regular shelf 30 in the form of a plate having a predetermined fixed area, and a variable shelf 40 capable of varying its surface area selectively as shown in FIG. 2. The variable shelf 40 is provided to enable at least one item having a relatively great height for an interval between the shelves 30 and 40 (at least one item having a height greater than the distance between the shelves 30 and 40), in the storage chamber 11. More specifically, as shown in FIG. 3, the variable shelf 40 includes a first partition shelf 410 disposed in the storage chamber 11 to partition a rear space of the storage chamber 11 into upper and lower spaces, a second partition shelf 420 movably mounted so as to be disposed in front of the first partition shelf 410 to partition a front space of the storage chamber 11 or overlapped with the first partition shelf 410, and a shelf frame 430 mounted to an inner wall of the storage chamber 11 to mount the first and second partition shelves 410 and 420 in the storage chamber 11 and guide the movement of the second partition shelf 420.

Therefore, in case that at least one relatively low item is to be stored (at least one item having a height less than the distance between the shelves is to be stored), the second partition shelf 420 is moved to the front of the first partition shelf 410 so that both of the front and rear spaces of the storage chamber 11 are partitioned by the first and second partition shelves 410 and 420. On the other hand, when at least one relatively high item compared to an interval between the shelves 30 and 40 is to be stored (at least one item having a height greater than the distance between the shelves 30 and 40 is to be stored), the second partition shelf 420 is moved to be overlapped with the first partition shelf 410 such that only the rear space of the storage chamber 11 is partitioned by the first partition shelf 410.

Furthermore, according to an exemplary embodiment, the rear space as well as the front space can be opened. For this, the second partition shelf 420 is structured to be movable relative to the first partition shelf 410 whereas the first partition shelf 410 is rotatable about a rear end thereof. Here, guide parts 410*a* are provided, being integrally extended downward from both sides of the first partition shelf 410, so as to achieve the movable mounting of the second partition shelf 420 with respect to the first partition shelf 410. First rails 411 are extended in the forward and the backward direction on inner surfaces of the guide parts 410*a* to movably mount both sides of the second partition shelf 420 thereto. Additionally, second rails 421 are extended in the forward and the backward direction on both sides of the second partition shelf 420 in the form corresponding to the first rails 411 to be movably mounted to the first rails 411, respectively. Each of the first rails 411 has a groove form recessed on an inner side of the guide part 410*a* while each of the second rails 421 has a projection form formed at both sides of the respective partition shelves 30 and 40.

The shelf frame 430 includes a pair of side frame parts 430*a* mounted on both inner sidewalls of the storage chamber 11, and a rear frame part 430*b* mounted to an inner rear wall of the storage chamber 11 to interconnect rear ends of the side frame parts 430*a*.

The shelf frame 430 is separably mounted in the storage chamber 11 so that the variable shelf 40 can be totally removed from storage chamber 11. For this, a pair of supporting parts 11*a* are protruded on the both inner sidewalls of the storage chamber 11 to face each other as shown in FIG. 2, so that the side frame parts 430*a* are supportedly put on upper parts of the supporting parts 11*a*. More particularly, plural pairs of the supporting parts 11*a* are arranged on the inner wall of the storage chamber 11 at vertical intervals. According to this, the variable shelf 40 may be totally separated from the storage chamber 11 as desired by a user or variably displaced up and down according to height of the item(s) to be stored in the storage chamber 11.

A pair of first hinge parts 431 having a recess form are formed at rear parts of the respective side frame parts 430*a* to rotatably connect the rear end of the first partition shelf 410. A pair of second hinge parts 412 protrude on both sides of the first partition shelf 410 to be rotatably mounted to the respective first hinge parts 431, and each hinge part 412 has a projection.

In addition, third rails 432 are formed on the side frame parts 430*a* of the shelf frame 430 at positions corresponding to the second rails 421, respectively, in order to guide the second partition shelf 420 moving toward the front of the first partition shelf 410. Since the second rails 421 are in the form of projections in exemplary embodiments, the third rails 432 are formed as grooves to guide the second rails 421.

Figure 4:
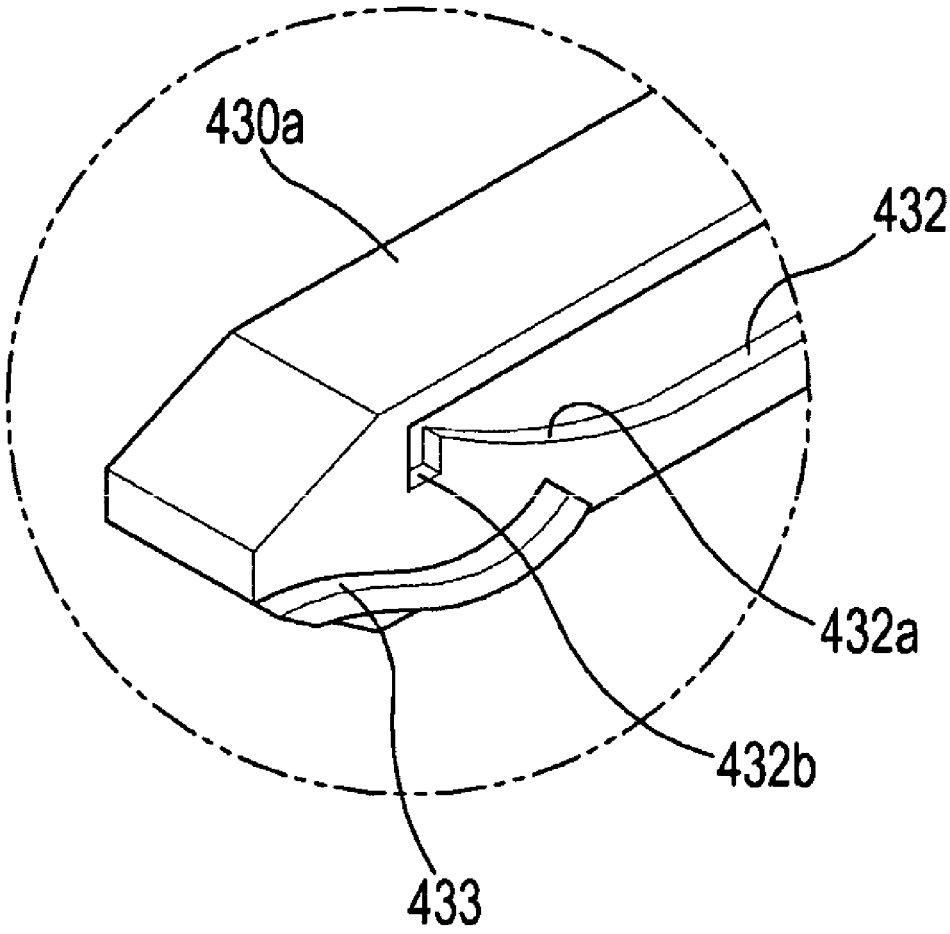
FIG. 4 is an enlarged view of a part IV in FIG. 3.

According to an exemplary embodiment, the second partition shelf 420 may be moved downward and backward to a lower part of the first partition shelf 410 from in front of and at the same height as the first partition shelf 410, or moved upward and forward to be in front of and at the same height as the first partition shelf 410 from the lower part of the first partition shelf 410. The above operation of the second partition shelf 420 may be achieved by forming a front part of each of the third rails 432 as an inclination part 432*a* extended toward an upper front part as shown in FIG. 4. In addition, a first locking part 432*b* is extended downward from a front end of the inclination part 432*a* of the third rail 432 to catch and support the second partition shelf 420 so that the second partition shelf 420 may be maintained positioned in front of the first partition shelf 410. Also, a second locking part 421*a* is formed at a front end of each of the second rails 421, being extended downward in the form corresponding to the first locking part 432*b* to be engaged with the first locking part 432*b*.

In a state where the second partition shelf 421*a* is engaged with the first locking part 432*b*, the load of item(s) placed on the second partition shelf 420 is concentrated on the first and second locking parts 432*b* and 421*a*. To relieve such concentration of the load, a supporting rib 433 supporting a front end of the second partition shelf 420 is protruded inward on a front inner side of the respective side frame parts 430*a*. According to an exemplary embodiment, the supporting rib 433 is slantingly extended toward the lower rear part so as to guide the front end of the second partition shelf 420 as the second locking part 421*a* is moving toward the rear lower part under the guidance of the inclination part 432*a*.

Referring to FIG. 3, a first guide projection 434 is protruded inward on the inner surface of the side frame part 430*a* to lift the rear end of the second partition shelf 420 upward in a state where the second partition shelf 420 is disposed in front of the first partition shelf 410 and maintain the lifted state of the rear end of the second partition shelf 420. A second guide projection 422 is protruded downward on both sides of the second partition shelf 420 for interaction with the first guide projection 434. A sectional shape of the first guide projection 434 has a convex-upward arc form so that the second guide projection 422 may be smoothly guided upward.

Hereinafter, the operation of the above-structured variable shelf applied to a refrigerator according to an exemplary embodiment will be described.

Figure 7:
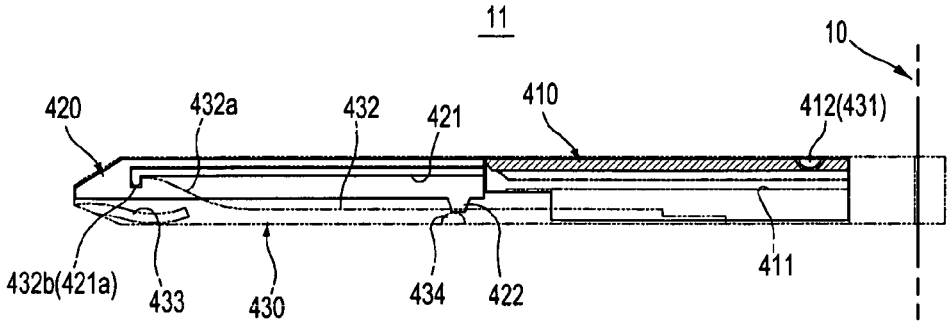
FIG. 7 to FIG. 10 are side sectional views showing the operation of a variable shelf according to an exemplary embodiment.

First, at the usual time, both the rear and the front spaces of the storage chamber 11 are partitioned by the first and second partition shelves 410 and 420 as shown in FIG. 2, so that various items having a relatively low height are stored. In this state, the second locking part 421*a* is in engagement with the first locking part 432*b*, the front end of the second partition shelf 420 is supported by the supporting rib 433, and the second guide projection 422 is supported by the first guide projection 434 as shown in FIG. 7.

Figure 5:
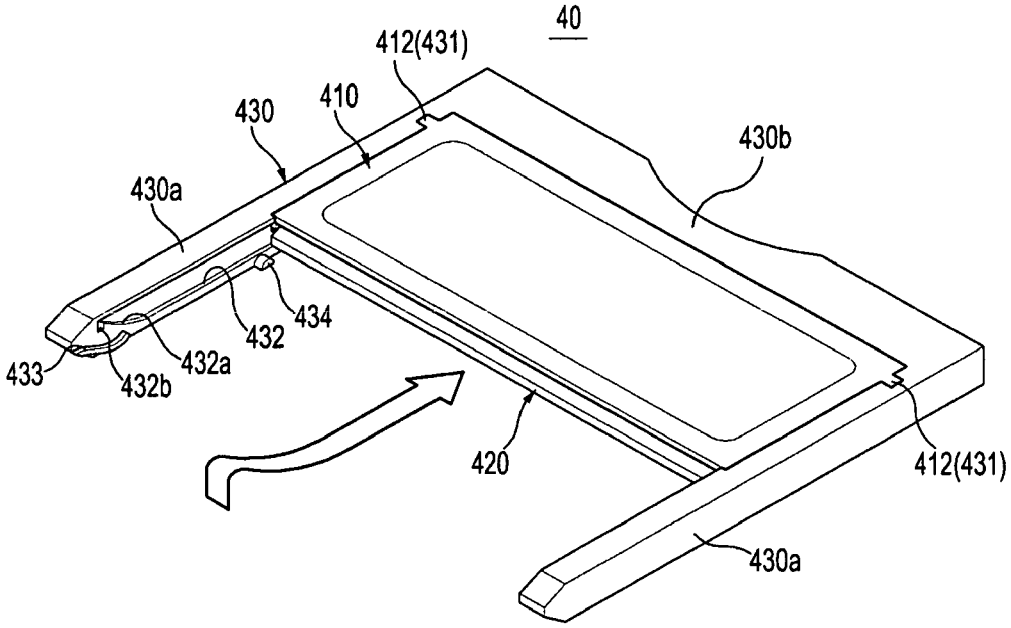
FIG. 5 and FIG. 6 are perspective views showing the operation of a variable shelf according to an exemplary embodiment.
Figure 8:
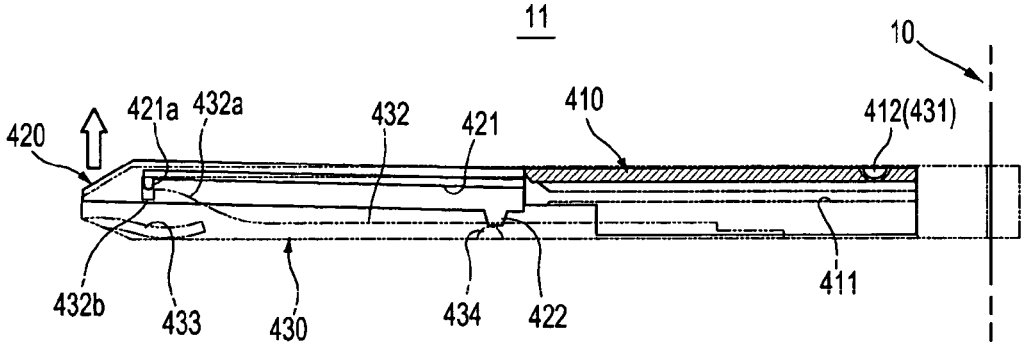
Figure 9:
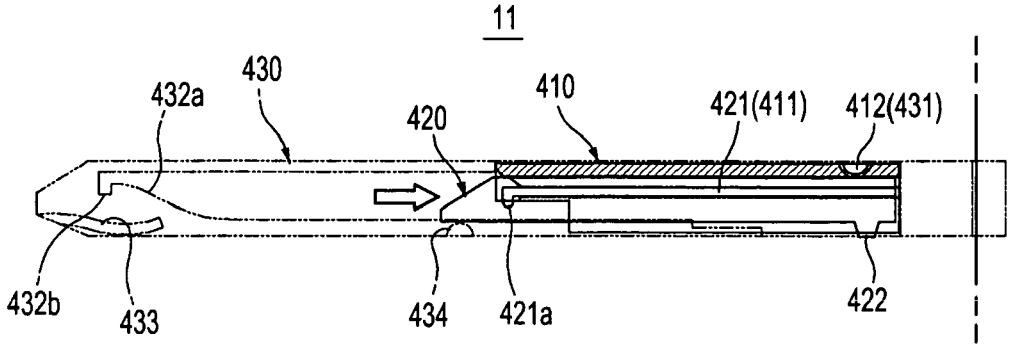

To store relatively high items, the user lifts the front end of the second partition shelf 420 as shown in FIG. 8. Therefore, the first locking part 432*b* is separated from the second locking part 421*a*. The second guide projection 422 being under the support of first guide projection 434 is moved to the rear part along an upper surface of the first guide projection 434, accordingly moving the second partition shelf 420 a bit to the rear part. If the user relieves the force exerted to the second partition shelf 420 in this state, the second partition shelf 420 is guided by the inclination part 432*a* through the second locking part 421*a* and moved to the rear lower part by its own weight. After the second partition shelf 420 is moved by a predetermined distance to the rear lower part by its own weight, when the user additionally applies a force to the second partition shelf 420 toward the rear part, the first rail 411 of the first partition shelf 410 is engaged with the second rail 421 of the second partition shelf 420. If the force is continuously applied toward the rear part, the second partition shelf 420 is moved to the rear part by being guided by the first rail 411 and overlappingly disposed at a lower part of the first partition shelf 410 as shown in FIG. 5 and FIG. 9. Accordingly, the front space of the storage chamber 11 that has been partitioned by the second partition shelf 420 is now opened and becomes able to store the relatively high item(s).

Figure 6:
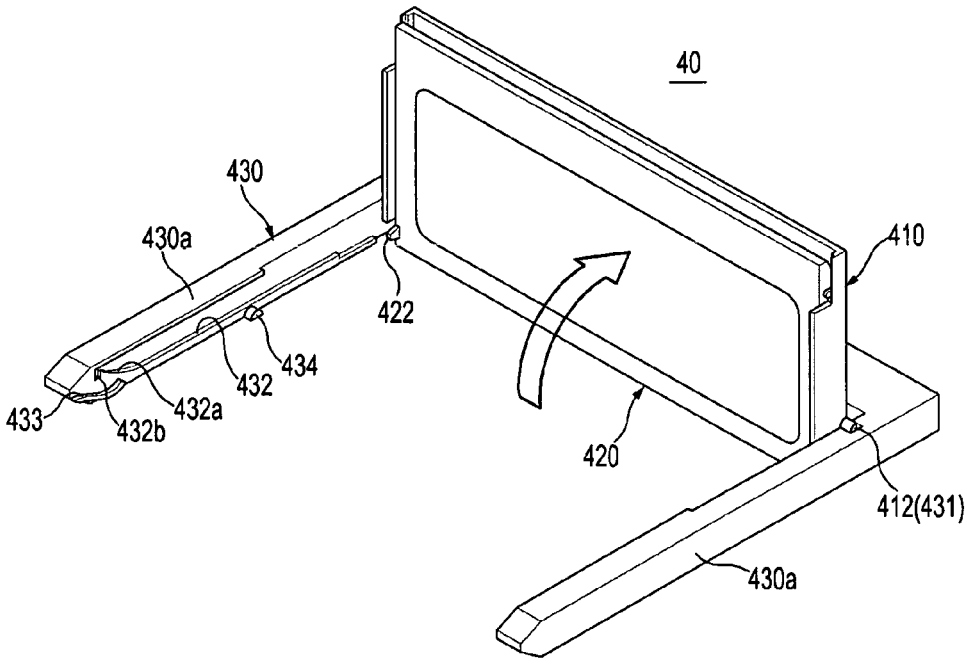
Figure 10:
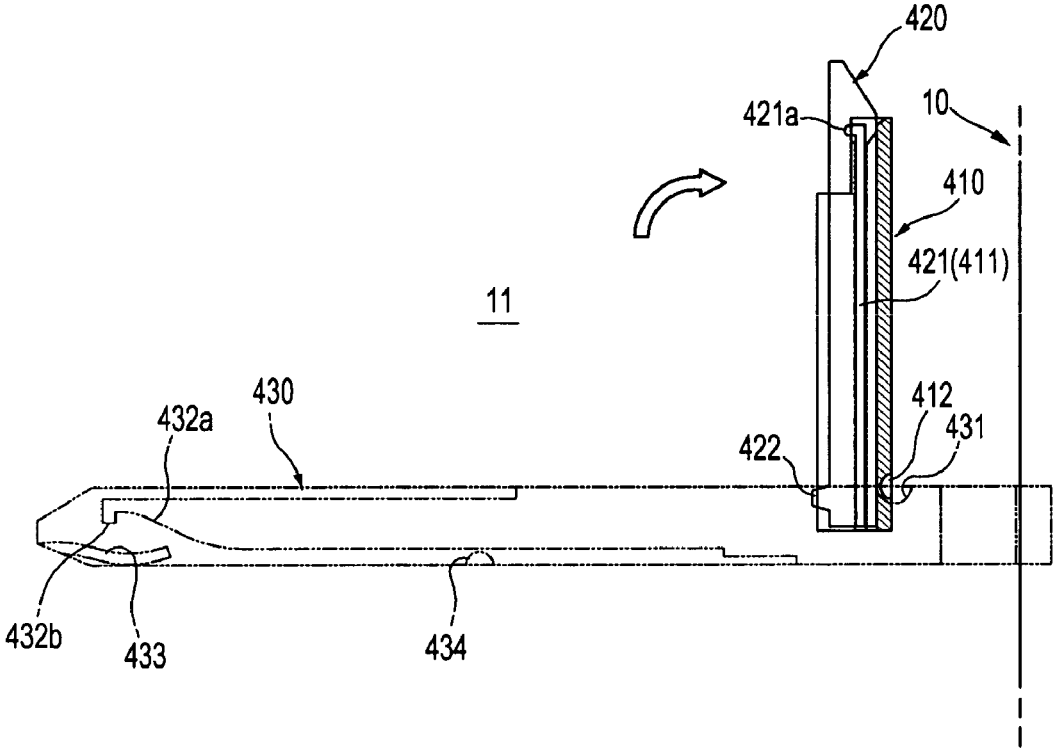

When it is required to store an item(s) not only higher than the interval between the shelves 30 and 40 but also wider than a front-to-rear width of the second partition shelf 420, a force is applied to the first partition shelf 410 being overlapped with the second partition shelf 420, so that the first partition shelf 410 is pivoted upward about the second hinge part 412 and therefore an upper surface of the first partition shelf 410 faces the inner rear wall of the storage chamber 11 as shown in FIG. 6 and FIG. 10. Accordingly, the rear space of the storage chamber 11 that has been partitioned by the first partition shelf 410 is also opened. That is, since the front space and the rear space of the storage chamber 11 partitioned by the second partition shelf 420 and the first partition shelf 410, respectively, are both opened in the up and down direction, even the high and wide item(s) may be stored in the storage chamber 11.

The shelf frame 430 according to an exemplary embodiment is formed as a separate part from the storage chamber 11 and removably connected in the storage chamber 11. However, not limited to this exemplary embodiment, the shelf frame 430 may be integrally formed with the inner surface of the storage chamber 11.

Also, although the variable shelf 40 has been explained as applied to a refrigerator in an exemplary embodiment, the variable shelf 40 may be applied to any other products adopting shelves.

As is apparent from the above description, according to a variable shelf and a refrigerator having the same in accordance with an exemplary embodiment, even item(s) higher than an interval between shelves and wider than a front-to-rear width of a second partition shelf may be stored in a storage chamber, by pivoting a first partition shelf and the second partition shelf about a rear end of the first partition shelf in a state where the second partition shelf is overlappingly disposed at a lower part of the first partition shelf.

Although a few exemplary embodiments have been shown and described, it would be appreciated by those skilled in the art that changes may be made to these exemplary embodiments without departing from the principles and spirit of the present disclosure, the scope of which is defined in the claims and their equivalents.

What is claimed is:

1. A variable shelf comprising:

a first partition shelf mounted to be pivotable about a rear end thereof; and a second partition shelf mounted to move relative to the first partition shelf, which enables the second partition shelf to protrude in front of the first partition shelf;

a shelf frame having a pair of side frame parts supporting both sides of the first and second partition shelves, wherein the rear end of the first partition shelf is pivotably mounted on the shelf frame, the shelf frame guides the second partition shelf moving toward the front of the first partition shelf, and the side frame parts comprise an inclined portion formed at the front end thereof to guide the second partition shelf upward such that a top surface of the second partition shelf is substantially even with a top surface of the first partition shelf, wherein each of the side frame parts comprises:

a first guide projection protruded inwardly from the side frame part to guide a rear end of the second partition shelf; and the second partition shelf comprises a second guide projection protruded downward from each side of the second partition shelf to guide the rear end of the second partition shelf upward through interaction with the first guide projection.

2. The variable shelf according to claim 1, further comprising:

a first hinge part formed as a recess and disposed at the rear end of the shelf frame; and a second hinge part formed as a projection and disposed at the rear end of the first partition shelf in order to be rotatably connected with the first hinge part.

3. The variable shelf according to claim 1, further comprising:

first rails each formed on both sides of the first partition shelf, being extended in the forward and the backward direction; and second rails each formed on both sides of the partition shelf and movably connected to the first rails.

4. The variable shelf according to claim 3, further comprising:

third rails each extended in the forward and the backward direction on insides of the pair of side frame parts so that the second rails are movably mounted to the third rails.

5. The variable shelf according to claim 4, wherein each of the third rails comprises an inclination part formed at a front end thereof and slantingly extended to an upper front part and a first locking part extended downward from the front end of the inclination part, and each of the second rails comprises a second locking part extended downward from the front end thereof and engaged with the first locking part.

6. The variable shelf according to claim 4, wherein each of the side frame parts comprises:

a first guide projection protruded inwardly from the side frame part to guide a rear end of the second partition shelf; and the second partition shelf comprises a second guide projection protruded downward from each side of the second partition shelf to guide the rear end of the second storage partition shelf upward through interaction with the first guide projection.

7. The variable shelf according to claim 1, further comprising a pair of supporting ribs protruded from front inner sides of the pair of side frame parts to support both front ends of the second partition shelf.

8. The variable shelf according to claim 7, wherein the pair of supporting ribs are slantingly extended toward a rear lower part.

9. A refrigerator comprising:

a main body including a storage chamber; and a variable shelf partitioning an inner space of the storage chamber into upper and lower spaces, wherein the variable shelf comprises:

a first partition shelf mounted to be pivotable about a rear end thereof;

a second partition shelf mounted to move relative to the first partition shelf, which enables the second partition shelf to protrude in front of the first partition shelf;

a shelf frame having a pair of side frame parts supporting both sides of the first and second partition shelves, wherein the rear end of the first partition shelf is pivotably mounted on the shelf frame, and the shelf frame guides the second partition shelf moving toward the front of the first partition shelf, and the side frame parts comprise an inclined portion formed at the front end thereof to guide the second partition shelf upward such that a top surface of the second partition shelf is substantially even with a top surface of the first partition shelf, wherein each of the side frame parts comprises:

a first guide projection protruded inwardly from the side frame part to guide a rear end of the second partition shelf; and the second partition shelf comprises a second guide projection protruded downward from each side of the second partition shelf to guide the rear end of the second partition shelf upward through interaction with the first guide projection.

10. The refrigerator according to claim 9, further comprising:

a first hinge part formed as a recess and disposed at the rear end of the shelf frame; and a second hinge part formed as a projection and disposed at the rear end of the shelf frame in order to be rotatably connected with the first hinge part.

11. The refrigerator according to claim 9, wherein the shelf frame is removably mounted in the storage chamber.

12. The refrigerator according to claim 11, further comprising a pair of supporting parts formed at both sides in the storage chamber to put the side frame parts thereon, respectively.

13. The refrigerator according to claim 9, further comprising:

first rails each formed on both sides of the first partition shelf, being extended in the forward and the backward direction;

second rails each formed on both sides of the partition shelf and movably connected to the first rails; and third rails each extended in the forward and the backward direction on insides of the pair of side frame parts so that the second rails are movably mounted to the third rails.

14. The refrigerator according to claim 13, wherein each of the third rails comprises an inclination part formed at a front end thereof and slantingly extended to an upper front part and a first locking part extended downward from the front end of the inclination part, and each of the second rails comprises a second locking part extended downward from the front end thereof and engaged with the first locking part.

15. A refrigerator comprising:

a main body including a storage chamber;

a variable shelf partitioning an inner space of the storage chamber into upper and lower spaces, and comprising a first partition shelf mounted to be pivotable about a rear end thereof, and a second partition shelf mounted to move relative to the first partition shelf, which enables the second partition shelf to protrude in front of the first partition shelf; and a shelf frame removably mounted in the storage chamber, having a pair of side frame parts mounted at both inner sidewalls of the storage chamber to support both sides of the first and second partition shelves, wherein the rear end of the first partition shelf is pivotably mounted on the shelf frame, and the shelf frame guides the second partition shelf moving toward the front of the first partition shelf, and the side frame parts comprise an inclined portion formed at the front end thereof to guide the second partition shelf upward such that a top surface of the second partition shelf is substantially even with a top surface of the first partition shelf, wherein each of the side frame parts comprises:

a first guide projection protruded inwardly from the side frame part to guide a rear end of the second partition shelf; and the second partition shelf comprises a second guide projection protruded downward from each side of the second partition shelf to guide the rear end of the second partition shelf upward through interaction with the first guide projection.

* * * * *